US010774505B2

(12) United States Patent
Fujii et al.

(10) Patent No.: US 10,774,505 B2
(45) Date of Patent: Sep. 15, 2020

(54) WORK MACHINE CONTROL SYSTEM, WORK MACHINE, AND WORK MACHINE CONTROL METHOD

(71) Applicant: Komatsu Ltd., Tokyo (JP)

(72) Inventors: Yuto Fujii, Tokyo (JP); Kota Beppu, Tokyo (JP)

(73) Assignee: KOMATSU LTD., Tokyo (JP)

( * ) Notice: Subject to any disclaimer, the term of this patent is extended or adjusted under 35 U.S.C. 154(b) by 81 days.

(21) Appl. No.: 15/525,359

(22) PCT Filed: Jan. 13, 2017

(86) PCT No.: PCT/JP2017/001143

§ 371 (c)(1),
(2) Date: May 9, 2017

(87) PCT Pub. No.: WO2017/119517

PCT Pub. Date: Jul. 13, 2017

(65) Prior Publication Data

US 2018/0202129 A1 Jul. 19, 2018

(51) Int. Cl.

| | |
|---|---|
| ***E02F 9/26*** | (2006.01) |
| ***E02F 3/84*** | (2006.01) |
| ***E02F 9/20*** | (2006.01) |

(52) U.S. Cl.

CPC ..... *E02F 9/261* (2013.01); *E02F 3/841* (2013.01); *E02F 3/842* (2013.01); *E02F 3/844* (2013.01);

(Continued)

(58) Field of Classification Search

CPC ... E02F 3/841; E02F 3/844; E02F 9/20; E02F 9/2041; E02F 9/261; E02F 9/262

See application file for complete search history.

(56) References Cited

U.S. PATENT DOCUMENTS 6,546,334 B1 * 4/2003 Fukuchi ..... G01C 21/26 342/357.31
2005/0274879 A1 * 12/2005 Osaragi ..... E02F 3/847 250/231.13

(Continued)

FOREIGN PATENT DOCUMENTS

JP 2002-062802 A 2/2002
JP 2003-333590 A 11/2003

(Continued)

OTHER PUBLICATIONS

International Search Report and Written Opinion dated Apr. 18, 2017, issued for PCT/JP2017/001143.

*Primary Examiner* — Kira Nguyen
(74) *Attorney, Agent, or Firm* — Locke Lord LLP

(57) ABSTRACT

A work machine control system includes: an acquisition unit configured to acquire a plurality of pieces of current topographical data of a work site where a work machine including a work unit performs work; a setting unit configured to set predetermined first current topographical data and second current topographical data from the plurality of pieces of current topographical data acquired by the acquisition unit; and an arithmetic unit configured to calculate a difference between the first current topographical data and the second current topographical data, and obtain revision data to revise the first current topographical data based on the difference and parameter information related to the current topography of the work site.

6 Claims, 9 Drawing Sheets

(52) U.S. Cl.
CPC ..... *E02F 3/847* (2013.01); *E02F 9/2041* (2013.01); *E02F 9/262* (2013.01)

(56) References Cited

U.S. PATENT DOCUMENTS

| | | | | |
|---|---|---|---|---|
| 2009/0202109 | A1* | 8/2009 | Clar | G01C 15/00 382/104 |
| 2014/0222247 | A1* | 8/2014 | Friend | G05D 1/0276 701/2 |
| 2016/0024757 | A1 | 1/2016 | Nomura et al. | |
| 2016/0122969 | A1* | 5/2016 | Noborio | E02F 3/7613 701/50 |
| 2016/0170090 | A1* | 6/2016 | Collins | G01V 99/005 702/5 |
| 2016/0282872 | A1 | 9/2016 | Ahmed et al. | |
| 2017/0044728 | A1* | 2/2017 | Mennink | G01B 11/306 |
| 2018/0137446 | A1* | 5/2018 | Shike | E02D 17/18 |

FOREIGN PATENT DOCUMENTS

| | | | |
|---|---|---|---|
| JP | 2004-325777 | A | 11/2004 |
| JP | 2010-066117 | A | 3/2010 |
| JP | 2014-205955 | A | 10/2014 |
| JP | 2016-017931 | A | 2/2016 |
| WO | 2016/208276 | A1 | 12/2016 |

* cited by examiner

F1

| ANGLE GROUP | FIRST GROUP | SECOND GROUP | THIRD GROUP | FOURTH GROUP | FIFTH GROUP | SIXTH GROUP | SEV-ENTH GROUP |
|---|---|---|---|---|---|---|---|
| ESTIMATED ERROR AMOUNT | E1 | E2 | E3 | E4 | E5 | E6 | E7 |

WORK MACHINE CONTROL SYSTEM, WORK MACHINE, AND WORK MACHINE CONTROL METHOD

FIELD

The present invention relates to a work machine control system, a work machine, and a work machine control method.

BACKGROUND

Recently, an information and communication technology (ICT) is increasingly applied in a work machine such as a bulldozer. For example, there is a work machine or the like mounted with a global navigation satellite systems (GNSS) and the like and adapted to: detect own position; compare such positional information with current topographical data indicating a current topography of a work site; and find a position, a posture, or the like of a work unit by performing arithmetic processing (refer to Patent Literature 1, for example). The current topographical data is managed by, for example, an external server and the like, and transmitted to the work machine from such a server. The work machine receives one kind of current topographical data transmitted from the server, and performs arithmetic processing and the like.

CITATION LIST

Patent Literature

Patent Literature 1: Japanese Laid-open Patent Publication No. 2014-205955

SUMMARY

Technical Problem

Recently, in such a work machine, it is requested to accurately perform automatic control for a work unit by using, for example, current topographical data. In this case, it may be difficult to accurately perform automatic control for a work unit depending on accuracy of current topographical data transmitted from a management device. Therefore, estimating accuracy of the current topographical data is required.

The present invention is made considering the above-described situation, and an object of the present invention is to provide a work machine control system, a work machine, and a work machine control method capable of estimating accuracy of current topographical data.

Solution to Problem

According to an aspect of the present invention, a work machine control system comprises: an acquisition unit configured to acquire a plurality of pieces of current topographical data of a work site where a work machine including a work unit performs work; a setting unit configured to set predetermined first current topographical data and second current topographical data from the plurality of pieces of current topographical data acquired by the acquisition unit; and an arithmetic unit configured to calculate a difference between the first current topographical data and the second current topographical data, and obtain revision data to revise the first current topographical data based on the difference and parameter information related to a current topography of the work site.

Advantageous Effects of Invention

According to an embodiment of the present invention, accuracy of the current topographical data can be estimated.

DESCRIPTION OF EMBODIMENTS

An embodiment of a work machine control system, a work machine, and a work machine control method according to the present invention will be described based on the drawings. Note that the present invention is not limited by the embodiment. Furthermore, note that components in the following embodiment include a component readily replaceable by a man skilled in the art or a component substantially identical thereto.

Figure 1:
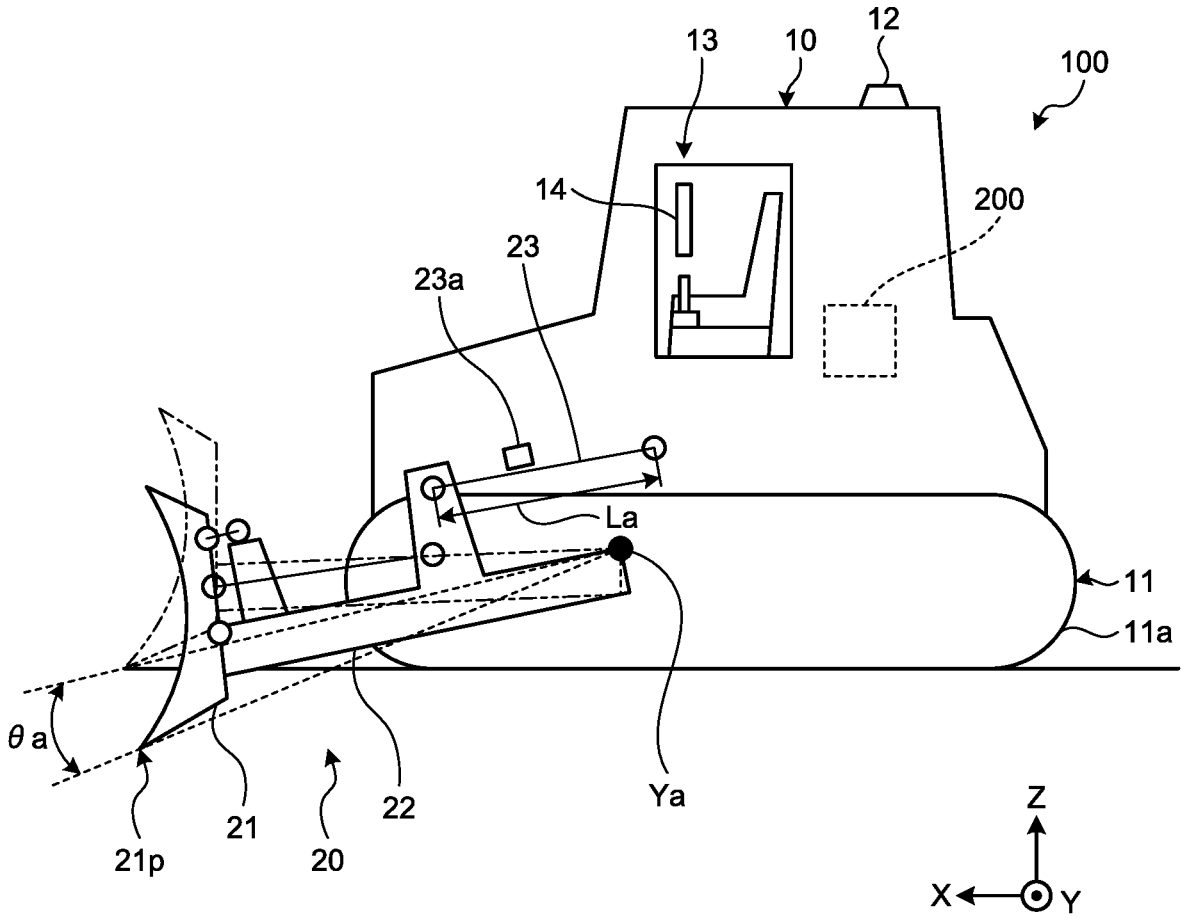
FIG. 1 is a view illustrating an exemplary work machine according to the present embodiment.

FIG. 1 is a view illustrating an exemplary work machine according to the present embodiment. In the present embodiment, a description will be provided by exemplifying a bulldozer 100 as a work machine. The bulldozer 100 includes a vehicle body 10 and a work unit 20. In the present embodiment, the bulldozer 100 is used in a work site such as a mine.

An X-axis, a Y-axis, a Z-axis illustrated in FIG. 1 represent an X-axis, a Y-axis, a Z-axis in a global coordinate system. In the present embodiment, a direction in which the work unit 20 is located relative to the vehicle body 10 is defined as a frontward direction. Therefore, a direction in which the vehicle body 10 is located relative to the work unit 20 is defined as a backward direction. In the present embodiment, a direction in which the vehicle body 10 is located relative to a ground contact surface where a crawler 11*a* contacts the ground is defined as an upward direction, and a direction directed from the vehicle body 10 to the ground contact surface, in other words, a gravity direction is defined as a downward direction. Note that, in FIG. 1, the bulldozer 100 is disposed in a state in which a front-back direction is made to coincide with the X-direction, a vehicle width direction is made to coincide with the Y-direction, and a vertical direction is made coincide with the Z-direction.

The vehicle body 10 includes a travel device 11 as a travel unit. The travel device 11 includes the crawler 11*a*. The crawler 11*a* is disposed on each of right and left sides of the vehicle body 10. The travel device 11 makes the bulldozer 100 travel by rotating the crawler 11*a* by a hydraulic motor not illustrated.

The vehicle body 10 includes an antenna 12. The antenna 12 is used to detect a current position of the bulldozer 100. The antenna 12 is electrically connected to a global coordinate arithmetic device 15. The global coordinate arithmetic device 15 is a position detector adapted to detect a position of the bulldozer 100. The global coordinate arithmetic device 15 detects the current position of the bulldozer 100 by utilizing global navigation satellite systems (GNSS represents global navigation satellite systems). In the following description, the antenna 12 will be suitably referred to as a GNSS antenna 12. A signal in accordance with GNSS radio waves received by the GNSS antenna 12 is received in the global coordinate arithmetic device 15. The global coordinate arithmetic device 15 finds a setting position of the GNSS antenna 12 in the global coordinate system (X, Y, Z) illustrated in FIG. 1. A global positioning system (GPS) can be exemplified as an example of the global navigation satellite system, but the global navigation satellite system is not limited thereto. It is preferable that the GNSS antenna 12 be set at an upper end of an operation room 13, for example.

The vehicle body 10 includes the operation room 13 provided with an operation seat to be seated by an operator. In the operation room 13, various kinds of operating devices and a display unit 14 to display image data are disposed. The display unit 14 is, for example, a liquid crystal device or the like, but not limited thereto. For the display unit 14, a touch panel integrating an input unit with a display unit can be used, for example. Additionally, an operating device not illustrated is provided in the operation room 13. The operating device is a device to operate at least one of the work unit 20 and the travel device 11.

The work unit 20 includes a blade 21 that is a working tool, a lift frame 22 to support the blade 21, and a lift cylinder 23 to drive the lift frame. The blade 21 includes a blade edge 21*p*. The blade edge 21*p* is disposed at a lower end portion of the blade 21. The blade edge 21*p* contacts the ground during work such as land grading work or excavation work. The blade 21 is supported by the vehicle body 10 via the lift frame 22. The lift cylinder 23 connects the vehicle body 10 to the lift frame 22. The lift cylinder 23 drives the lift frame 22 and vertically moves the blade 21. The work unit 20 includes a lift cylinder sensor 23*a*. The lift cylinder sensor 23*a* detects lift cylinder length data La representing a stoke length of the lift cylinder 23.

Figure 2:
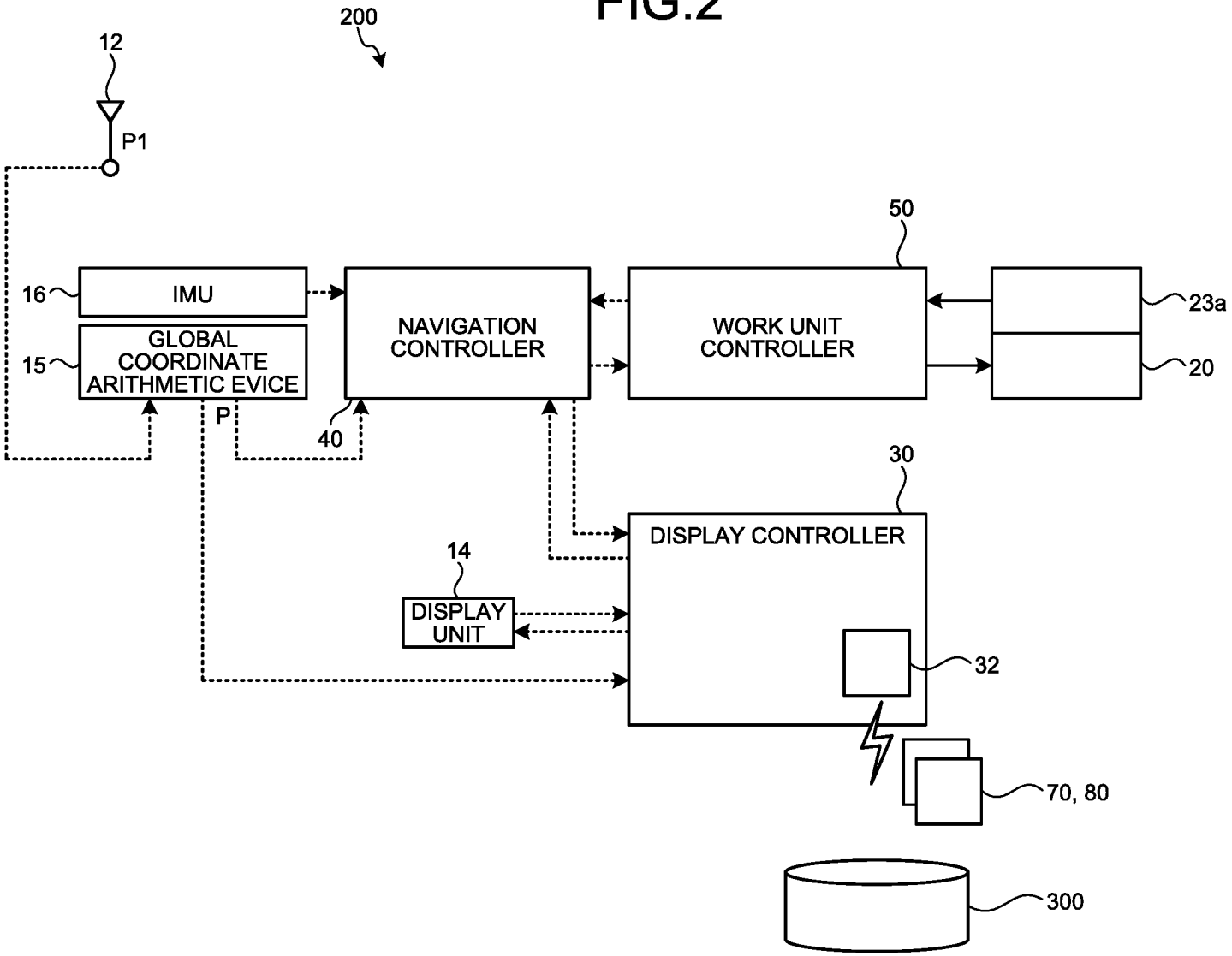
FIG. 2 is a block diagram illustrating an exemplary control system that is a work machine control system according to the present embodiment.

FIG. 2 is a block diagram illustrating an exemplary control system 200 that is a work machine control system according to the present embodiment. As illustrated in FIG. 2, the control system 200 includes: the global coordinate arithmetic device 15; an inertial measurement unit (IMU) 16 that is a state detector to detect an angular speed and an acceleration speed; a navigation controller 40; a display controller 30; and a work unit controller 50.

The global coordinate arithmetic device 15 acquires reference positional data P1 that is positional data of the antenna 12 indicated by the global coordinate system. The global coordinate arithmetic device 15 includes: a processing unit that is a processor such as a central processing unit (CPU); and a storage unit that is a storage device such as a random access memory (RAM) and a read only memory (ROM).

The global coordinate arithmetic device 15 generates positional data P indicating a position of the vehicle body 10 based on the reference positional data P1. The positional data P indicates a position in the global coordinate system (X, Y, Z). The global coordinate arithmetic device 15 outputs the generated positional data P to the navigation controller 40 and display controller 30.

The IMU 16 is the state detector to detect operational information of the bulldozer 100. In the embodiment, the operational information may include information indicating a posture of the bulldozer 100. Exemplary information indicating the posture of the bulldozer 100 may include a roll angle, a pitch angle, and an orientation angle of the bulldozer 100. The IMU 16 is mounted on the vehicle body 10. The IMU 16 may be installed at a lower portion of the operation room 13, for example.

The IMU 16 detects an angular speed and an acceleration speed of the bulldozer 100. With operation of the bulldozer 100, various kinds of acceleration speeds such as an acceleration speed generated during travel, an angular acceleration speed during swing, and a gravitational acceleration speed are generated in the bulldozer 100, and the IMU 16 detects and outputs at least the gravitational acceleration speed. Here the gravitational acceleration speed is an acceleration speed corresponding to resistance against gravity. The IMU 16 detects, for example, acceleration speeds in the X-axis direction, Y-axis direction, and Z-axis direction and angular speeds (rotation angular speeds) around the X-axis, Y-axis, and Z-axis in the global coordinate system (X, Y, Z).

The display controller 30 displays an image such as a guidance screen on the display unit 14. The display controller 30 includes a communication unit 32. The communication unit 32 can communicate with an external communication apparatus. The communication unit 32 receives, for example, current topographical data 70 and design topographical data 80 of a work site from a management server 300 and the like. The communication unit 32 may also receive the current topographical data 70 and design topographical data 80 of the work site from an external storage device such as a USB memory, a PC, a portable terminal, and so on.

The navigation controller 40 includes: a processing unit that is a processor such as a CPU; and a storage unit that is a storage device such as a RAM and a ROM. The navigation controller 40 receives a detection value of the global coordinate arithmetic device 15, a detection value of the IMU 16, and an output value from the work unit controller 50 described later. The navigation controller 40 finds positional information related to a position of the bulldozer 100 from the detection value of the global coordinate arithmetic device 15 and the detection value of the IMU 16, and outputs the same to the display controller 30. The navigation controller 40 receives blade edge positional data from the work unit controller 50. The blade edge positional data is data indicating a blade edge position that is a three-dimensional position of the blade edge 21*p*. The navigation controller 40 generates target blade edge positional data indicating a target blade edge position based on the blade edge positional data. The navigation controller 40 uses current topographical data indicating a current topography of a work site at the time of generating the target blade edge positional data. The navigation controller 40 generates, for example, a virtual target ground surface on which the current topography indicated by the current topographical data is offset downward by a predetermined distance, and generates the target blade edge positional data such that the blade edge 21*p* conforms to the virtual target ground surface.

The work unit controller (work unit control unit) 50 includes: a processing unit that is a processor such as a CPU; and a storage unit that is a storage device such as a RAM and a ROM. The work unit controller 50 detects the blade edge positional data by using positional information of the blade 21 and outputs the same to the navigation controller 40. The work unit controller 50 receives the target blade edge positional data from the navigation controller 40. The work unit controller 50 generates and outputs a work unit command value adapted to control operation of the work unit 20 based on the target blade edge positional data.

Figure 4:
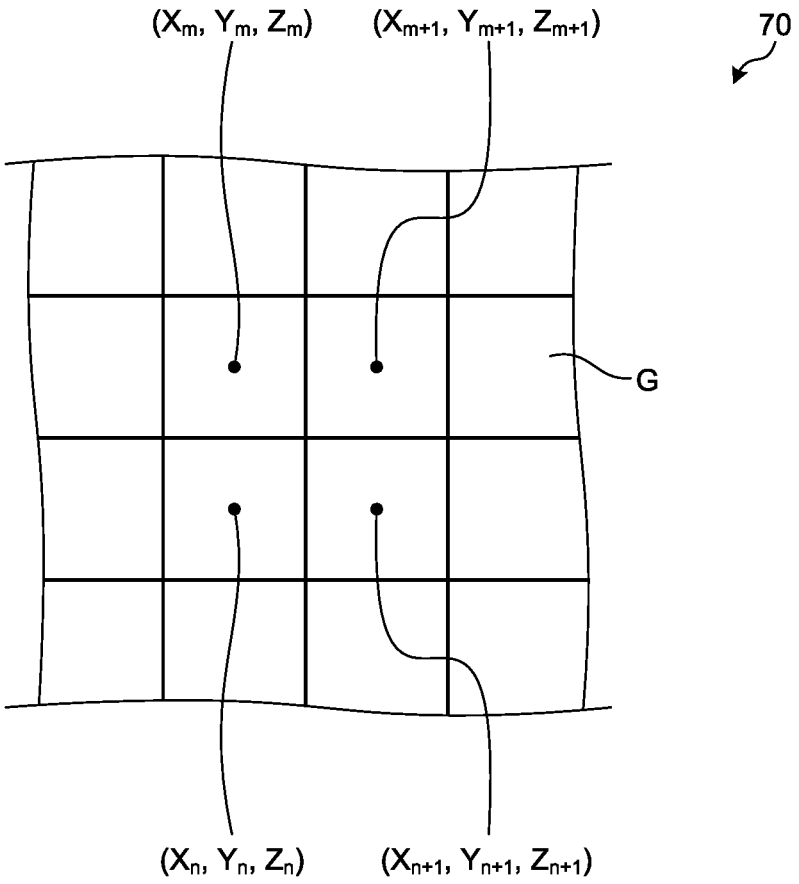
FIG. 4 is a diagram illustrating exemplary current topographical data.

FIG. 4 is a diagram illustrating exemplary current topographical data. As illustrated in FIG. 4, current topographical data 70 is data related to a height position (Z-coordinate) in each grid area G in the case of sectioning the work site into a plurality of grid areas G in the X-direction and Y-direction of the global coordinate system. Meanwhile, the current topographical data 70 is only needed to be the data related to height data of any position in a grid area G, and for example, may be height data at a center position of a grid area G or may also be height data at four corners of a grid area G. The grid area G is set to have a square shape, for example, but not limited thereto, and may have other shapes such as a rectangle, a parallelogram, and a triangle.

In the present embodiment, the current topographical data 70 is generated by, for example, measuring a current topography of a work site by using various kinds of measuring methods. The current topographical data 70 includes, for example, multiple kinds of current topographical data obtained by different measuring methods. Exemplary measuring methods adapted to generate the current topographical data 70 may include: a method of measuring a current topography by using positional information of a vehicle which travels in a work site; a method of measuring a current topography by using positional information of a work machine such as the bulldozer 100 which travels in a work site, a method of surveying a current topography by making a surveying vehicle travel; a method of surveying a current topography by using a stationary surveying instrument; a method of measuring a current topography by a stereo camera; and a method of measuring a current topography by an unmanned air vehicle such as a drone. Meanwhile, measurement by a drone and the like may be a method in which a current topography is photographed by using, for example, a camera and the like and current topographical data is measured based on this photographing result, or the current topographical data may be measured by using a laser scanner. Identifying information may also be assigned to the current topographical data 70 in order to identify a measuring method and the like.

Figure 3:
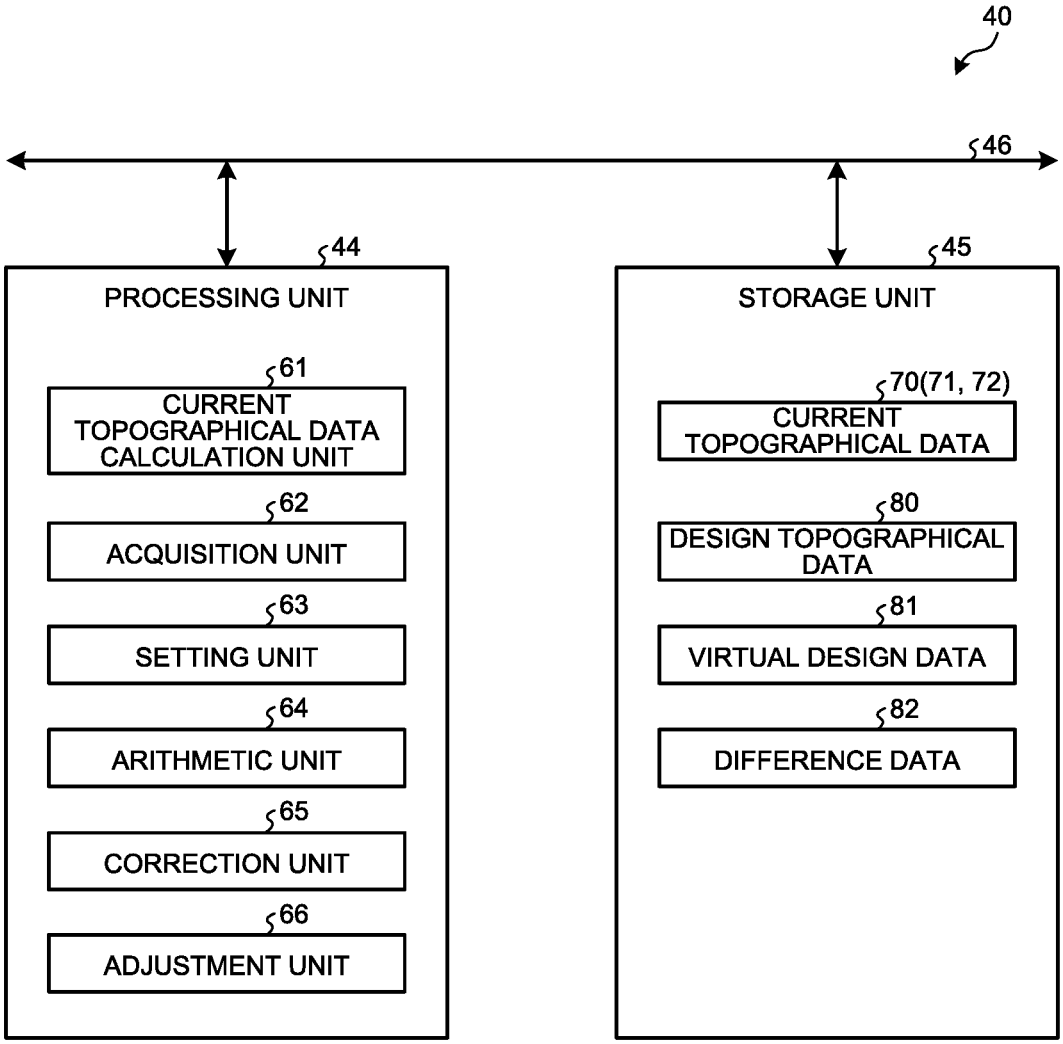
FIG. 3 is a block diagram illustrating an exemplary display controller.

FIG. 3 is a block diagram illustrating an exemplary navigation controller 40. As illustrated in FIG. 3, the navigation controller 40 includes a processing unit 44 and a storage unit 45. The navigation controller 40 has the processing unit 44 and the storage unit 45 connected via a signal line such as a bus line 46.

The processing unit 44 is a processor such as a CPU. The processing unit 44 includes a current topographical data calculation unit 61, an acquisition unit 62, a setting unit 63, and an arithmetic unit 64, a correction unit 65, and an adjustment unit 66.

The current topographical data calculation unit 61 calculates current topographical data 70 indicating a current topography for a region of the work site where, for example, the bulldozer 100 has passed. The current topographical data calculation unit 61 calculates the current topographical data 70 based on, for example, positional information output from the global coordinate arithmetic device 15. In this case, the current topographical data calculation unit 61 calculates, for example, a Z-coordinate in each of grid areas G corresponding to the region where the bulldozer 100 has passed.

The acquisition unit 62 acquires a plurality of pieces of the current topographical data 70 indicating a current topography of the work site. The current topographical data 70 acquired by the acquisition unit 62 includes, for example, current topographical data 70 received from a management server 300 and the current topographical data 70 generated in the current topographical data calculation unit 61.

Accuracy, a range including data, and the like of the plurality of pieces of current topographical data 70 acquired by the acquisition unit 62 may be varied by a measuring method and the like. For example, current topographical data 70 acquired by performing measurement by making a vehicle travel in the work site has low measurement accuracy because a travel speed during the measurement is fast. On the other hand, the number of grid areas G including data can be increased by measuring the current topographical data 70 by making the vehicle travel across a wide region of the work site.

Additionally, the bulldozer 100 travels at a speed slower than the above vehicle, and therefore, current topographical data 70 acquired by making the bulldozer 100 travel has high measurement accuracy because of the slow travel speed. On the other hand, since the bulldozer 100 mainly travels, for example, at places of the work site in order that the bulldozer 100 may perform work and move for the work, the number of grid areas G including data is limited.

Therefore, the acquisition unit 62 may acquire, for example, current topographical data 70 which is highly accurate and includes a small number of grid areas G and current topographical data 70 which is low accurate and includes a large number of grid areas G, in other words, the acquisition unit 62 may acquire the plurality of pieces of current topographical data 70 having different accuracy in a mixed manner. In this case, as for a grid area G including highly-accurate current topographical data 70, the processing can be performed by using this highly-accurate current topographical data 70. On the other hand, as for a grid area G not including such highly-accurate current topographical data 70, the processing is performed by using low-accurate current topographical data 70. In the present embodiment, in this case, the low-accurate current topographical data 70 is revised by using the highly-accurate current topographical data 70, thereby improving accuracy of the low-accurate current topographical data 70. In the following, the relatively low-accurate current topographical data 70 is defined as first current topographical data 71, and the highly-accurate current topographical data 70 is defined as second current topographical data 72.

The setting unit 63 sets the first current topographical data 71 and the second current topographical data 72 based on the plurality of pieces of current topographical data 70 acquired by the acquisition unit 62. The setting unit 63 may set the first current topographical data 71 and the second current topographical data 72 by any method. In the following, a description will be provided by exemplifying a case where a measuring method for current topographical data 70 set as the first current topographical data 71 and a measuring method for the current topographical data 72 set as the second current topographical data 72 are preliminarily determined, and the setting unit 63 sets the first current topographical data 71 and the second current topographical data 72 based on the methods by which the current topographical data 70 is measured.

The arithmetic unit 64 calculates, for each of the grid areas G, a height data difference between the first current topographical data 71 and the second current topographical data 72 at the same position in a grid area G. A plurality of height data differences calculated for each of the grid areas G is stored in the storage unit 45 as difference data 82.

Furthermore, the arithmetic unit 64 finds an estimated error function in order to revise the first current topographical data 71 based on the plurality of differences calculated for each of the grid areas G and later-described parameter information related to a current topography of a work site. The estimated error function is an example of revision data. The inventor of the present invention has discovered correlation that, for example, the larger an inclination angle relative to a horizontal plane a grid area G has, the larger height data difference is in the current topographical data 70. Therefore, in the present embodiment, a description will be provided by exemplifying an inclination angle relative to the horizontal plane in each of the grid areas G as the parameter information. In this case, the arithmetic unit 64 calculates, for each grid area G, an inclination angle relative to the horizontal plane, categorizes each grid areas G as one of a plurality of groups based on an angle size of the calculated inclination angle, and sets the group as the parameter information. In the following, a procedure by which the arithmetic unit 64 sets the parameter information will be described.

Figure 5:
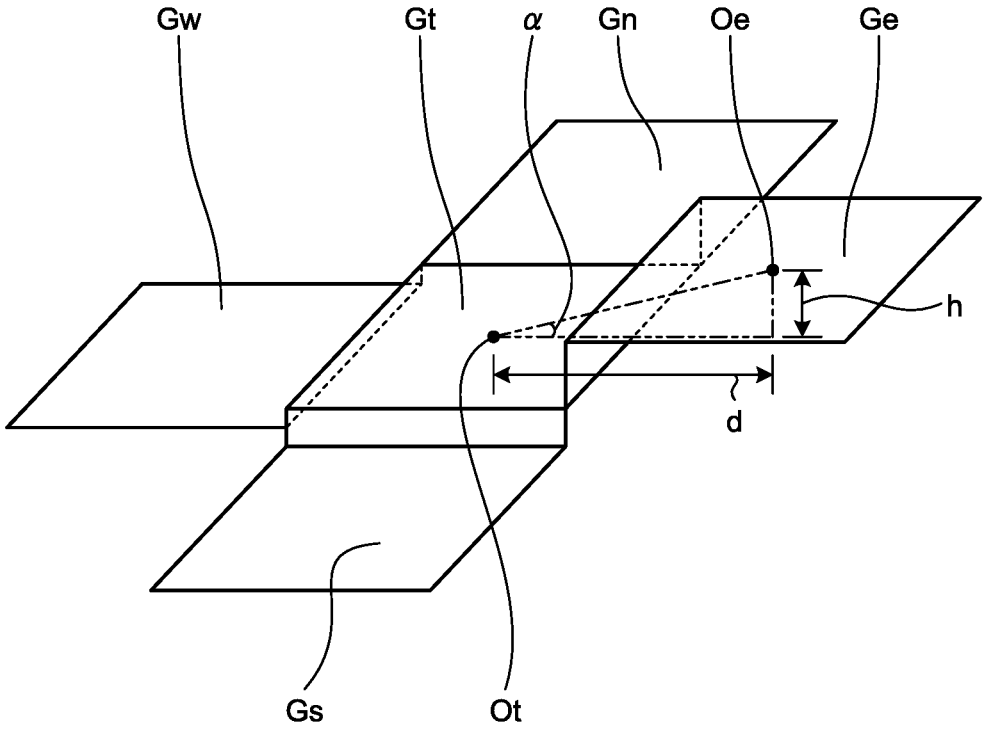
FIG. 5 is a schematic diagram illustrating a state of calculating an inclination angle.

FIG. 5 is a schematic diagram illustrating a state of calculating an inclination angle. As illustrated in FIG. 5, in the case of finding an inclination angle in one grid area Gt, the arithmetic unit 64 finds a height position difference between the grid area Gt and peripheral grid areas. In the present embodiment, four grid areas Gn, Gs, Ge, Gw which share respective sides of the grid area Gt are included as the peripheral grid areas of the grid area Gt. Meanwhile, the peripheral grid areas of the grid area Gt may also include grid areas G obliquely adjacent to the grid area Gt instead of the above four grid areas Gn, Gs, Ge, Gw or in addition to the above four grid areas Gn, Gs, Ge, Gw.

In FIG. 5, a height position difference h between the grid area Gt and the grid area Ge is illustrated as an example. The arithmetic unit 64 calculates such a height position difference between the grid area Gt and each of the grid areas Gn, Gs, Ge, Gw. The arithmetic unit 64 calculates an angle $\alpha$ based on the calculated height position difference and a pitch d of a grid area. In this case, the angle $\alpha$ is an angle between the horizontal plane and each of straight lines connecting a center point Ot of the grid area Gt to each of center points of the grid areas Gn, Gs, Ge, Gw (center point Oe is illustrated in FIG. 5). The arithmetic unit 64 adopts, for example, a largest value among the calculated four angles $\alpha$ as the inclination angle of the grid area Gt. Meanwhile, the arithmetic unit 64 may also adopt an average value of the calculated four angles $\alpha$ as the inclination angle of the grid area Gt.

Figures 6, 7:
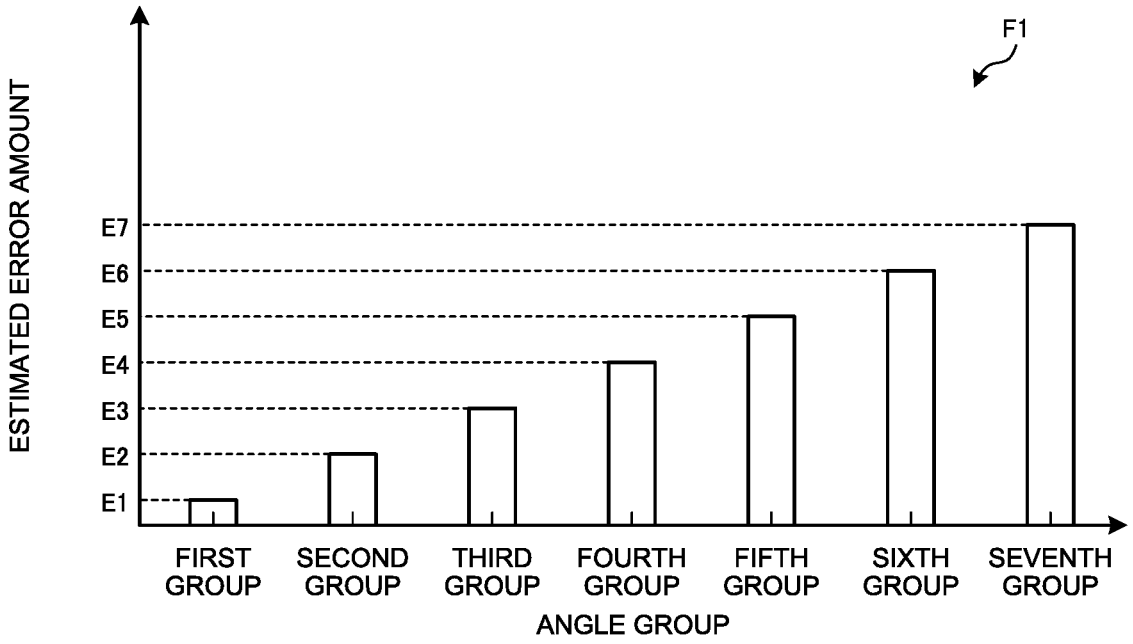
FIG. 6 is a table illustrating a correspondence relation between an angle group and an estimated error amount.
FIG. 7 is a histogram illustrating an exemplary estimated error function.

In the case of calculating the inclination angle, the arithmetic unit 64 categorizes the calculated inclination angle as one of the plurality of angle groups (groups) based on angle size. FIG. 6 is a table illustrating a correspondence relation between an angle group and an estimated error amount. As illustrated in FIG. 6, the arithmetic unit 64 categorizes an inclination angle into one of, for example, seven groups including first to seventh groups based on the angle size of the inclination angle.

For example, in the case where angles $\alpha1$, $\alpha2$, $\alpha3$, $\alpha4$, $\alpha5$, $\alpha6$ satisfy a relation of $\alpha1<\alpha2<\alpha3<\alpha4<\alpha5<\alpha6$, the first group is a group which a grid area G having an inclination angle of 0° or more and less than $\alpha1°$ belongs to. The second group is a group which a grid area G having an inclination angle of $\alpha1°$ or more and less than $\alpha2°$ belongs to. The third group is a group which a grid area G having an inclination angle of $\alpha2°$ or more and less than $\alpha3°$ belongs to. The fourth group is a group which a grid area G having an inclination angle of $\alpha3°$ or more and less than $\alpha4°$ belongs to. The fifth group is a group which a grid area G having an inclination angle of $\alpha4°$ or more and less than $\alpha5°$ belongs to. The sixth group is a group which a grid area G having an inclination angle of $\alpha5°$ or more and less than $\alpha6°$ belongs to. The seventh group is a group which a grid area G having an inclination angle of $\alpha6°$ or more belongs to. Thus, the arithmetic unit 64 sets the parameter information by setting the plurality of angle groups (groups).

The arithmetic unit 64 finds an estimated error function in order to revise the first current topographical data 71 based on the calculated plurality of differences and the parameter information. In the following, a procedure by which the arithmetic unit 64 finds an estimated error function will be described. In the present embodiment, the arithmetic unit 64 finds an estimated error amount for each angle group that is the parameter information. Specifically, the arithmetic unit 64 finds a height data difference between the first current topographical data 71 and the second current topographical data 72 at the same position in a grid area G for each of the plurality of grid areas G belonging to the respective angle groups, and calculates an average value or a center value of the differences, for example. The calculated result is an estimated error amount in the angle group. As illustrated in FIG. 6, estimated error amounts (E1 to E7) are found for the respective groups formed of the first to seventh groups. Thus, the arithmetic unit 64 correlates the angle group (angle information) that is the parameter information to the estimated error amount, thereby finding an estimated error function F1 indicating a relation between the angle group and the estimated error amount. In the present embodiment, the estimated error function F1 includes all of relations between the respective angle groups from first to seventh groups and the estimated error amounts (E1 to E7) of the respective angle groups. In the present embodiment, the arithmetic unit 64 may create, for example, a histogram in which an angle group is correlated to an error estimated amount on a one-to-one basis as a style of the estimated error function F1.

FIG. 7 is a histogram illustrating an estimated error function, and specifically illustrates a relation between an angle group to which a grid area G belongs and an estimated error amount. A horizontal axis in FIG. 7 represents the angle group, and a vertical axis in FIG. 7 represents the estimated error amount (unit: m). As illustrated in FIG. 7, the estimated error amounts satisfy a relation of E1<E2<E3<E4<E5<E6<E7. As understood from FIG. 7, a grid area G belonging to an angle group having a larger inclination angle has a larger estimated error amount in the grid area G.

Figure 8:
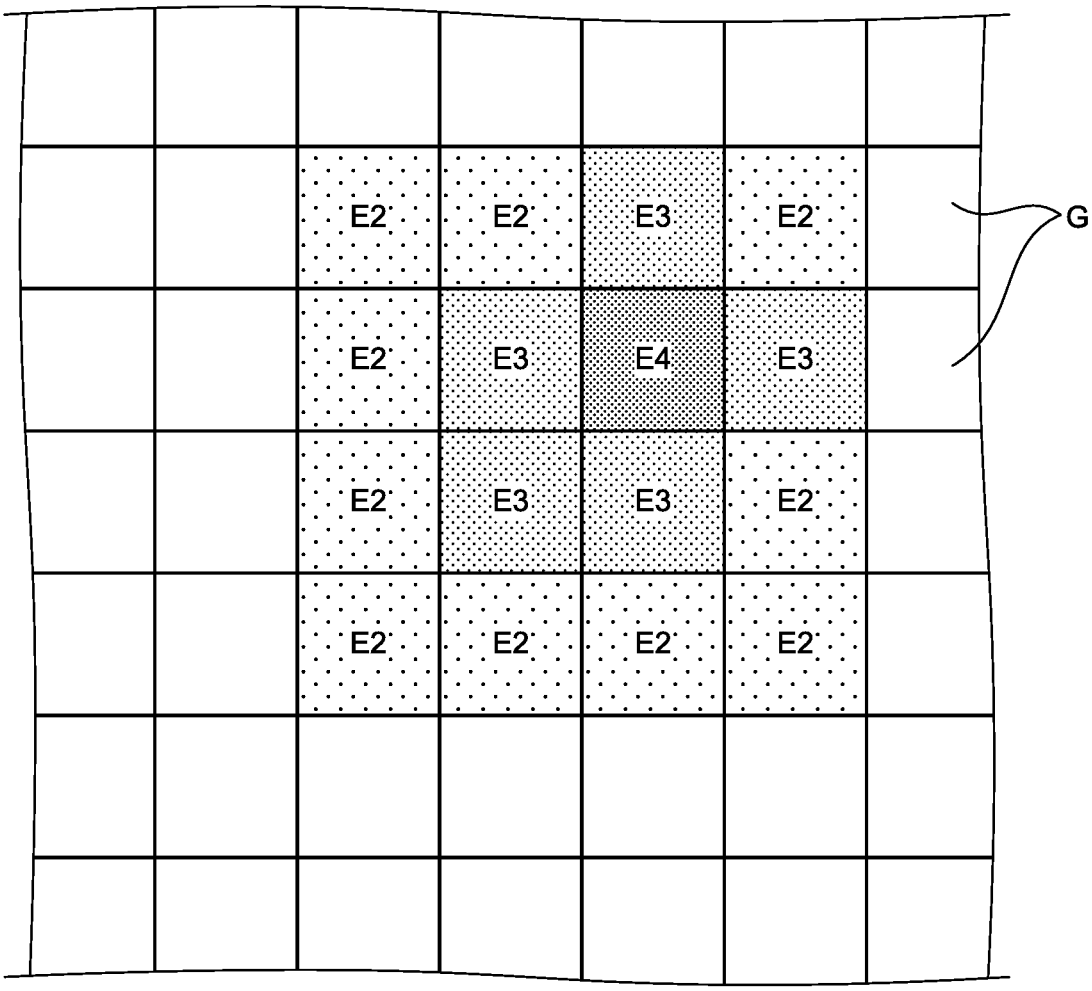
FIG. 8 is a diagram schematically illustrating processing to find an estimated error amount for each grid area.

Additionally, FIG. 8 is a diagram schematically illustrating processing to find an estimated error amount for each grid area G. Based on the estimated error function F1, the arithmetic unit 64 finds, for each grid area G, an estimated error amount corresponding to an angle group which the grid area G belongs to.

The correction unit 65 corrects the first current topographical data 71 based on the estimated error function F1 found in the arithmetic unit 64. Meanwhile, the correction unit 65 may also correct the first current topographical data 71 only in the case where a value of the first current topographical data 71 becomes smaller before and after correction. In this case, the value of the current topographical data 71 can be prevented from becoming larger than an actual current topography. Therefore, the blade edge 21*p* of the blade 21 can be prevented from separating from the ground at the time of automatically controlling the work unit 20. For example, in the case of automatically controlling the work unit 20 based on the first current topographical data 71 in a grid area G including no second current topographical data 72 and including only the first current topographical data 71, the correction unit 65 revises height data of the first current topographical data 71 by an estimated error amount. As a result, the ground of a work site can be surely excavated and so-called missed swing of the blade 21 can be avoided.

In the case of newly obtaining difference data 82 between the second current topographical data 72 and the first current topographical data 71 in a state in which the estimated error amounts E1, E2, E3, E4, E5, E6, E7 have been found, the adjustment unit 66 updates the estimated error amounts by using new difference data 82. For example, in the case where the bulldozer 100 newly travels in a grid area G not including so far highly-accurate second current topographical data 72 and including only the relatively low-accurate first current topographical data 71 and then second current topographical data 72 is newly generated for this grid area G, an estimated error amount that has been already calculated can be updated by using difference data 82 in this grid area G to calculate an estimated error amount.

Figure 9:
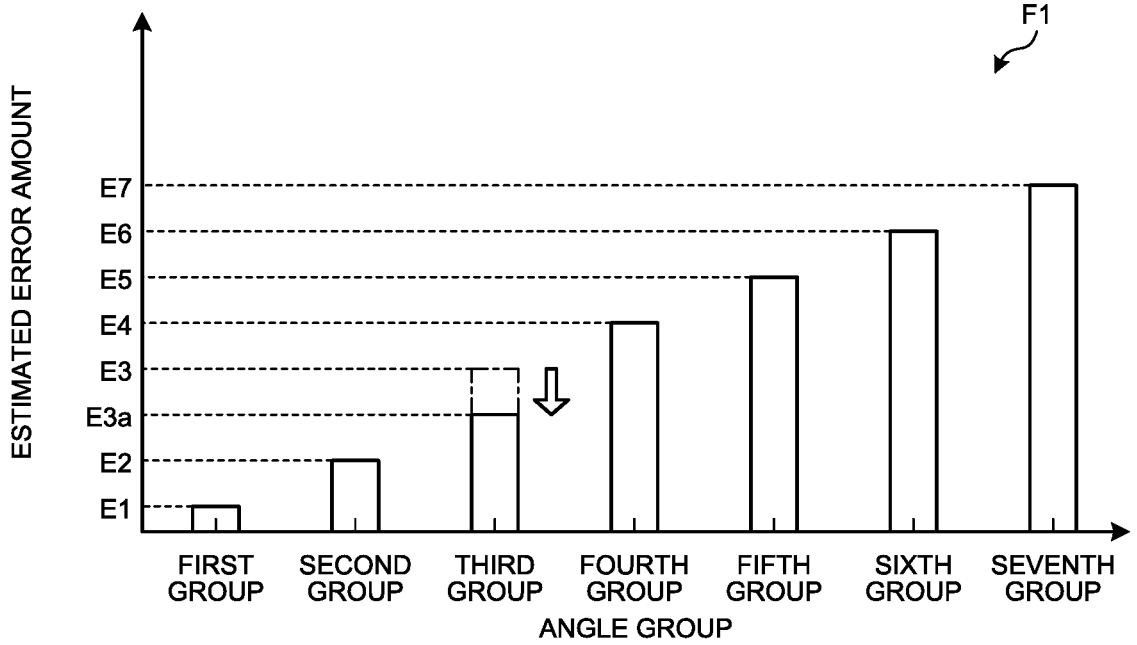
FIG. 9 is a graph schematically illustrating processing to adjust an estimated error amount.

In this case, the adjustment unit 66 calculates differences for a plurality of grid areas G belonging to the respective angle groups in a similar manner as the arithmetic unit 64 does, and calculates an average value or a center value of the differences, for example. FIG. 9 is a graph schematically illustrating processing to adjust an estimated error amount, in which a horizontal axis represents the angle group, and a vertical axis represents the estimated error amount in a similar manner as FIG. 7.

For example, as for a plurality of grid areas G belonging to the third group, an estimated error amount of the third group is, for example, E3 before adjustment processing by the adjustment unit 66. In the case where the estimated error amount becomes E3*a* as a result of adjustment processing by the adjustment unit 66, in other words, as a result of re-calculation of an estimated error amount by using newly-added second current topographical data 72, the adjustment unit 66 changes the estimated error amount of the third group from E3 to E3*a* as illustrated in FIG. 9.

Additionally, the storage unit 45 stores current topographical data 70, design topographical data 80, difference data 82, and an estimated error function F1. Furthermore, the storage unit 45 stores programs, data, and the like in order to execute various kinds of processing in the processing unit 44.

Figure 10:
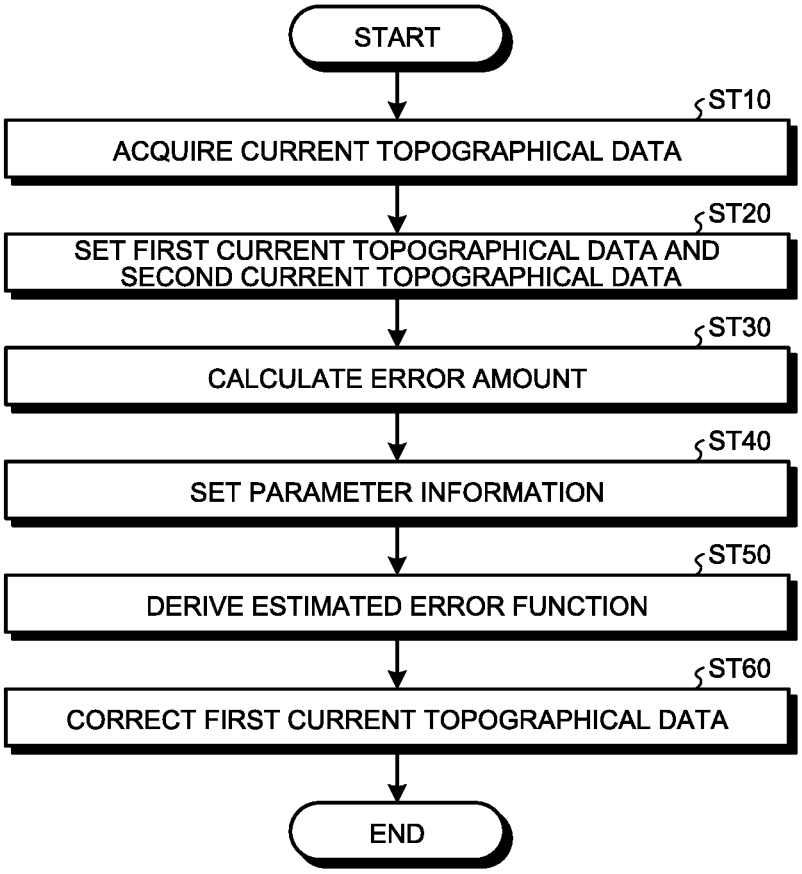
FIG. 10 is a flowchart illustrating an exemplary work machine control method according to the present embodiment.

FIG. 10 is a flowchart illustrating an exemplary work machine control method according to the present embodiment. In Step ST10, the acquisition unit 62 of the navigation controller 40 acquires current topographical data 70. Examples of the current topographical data 70 may include current topographical data 70 received from the management server 300 and current topographical data 70 generated in the current topographical data calculation unit 61.

Next, the setting unit 63 sets first current topographical data 71 and second current topographical data 72 based on a plurality of pieces of current topographical data 70 acquired by the acquisition unit 62 (Step ST20). In Step ST20, the setting unit 63 sets data close to an actual current topography, namely, highly-accurate data as the second current topographical data 72 so as to use the second current topographical data 72 as teaching data (reference data for revision) in order to revise the first current topographical data 71. Additionally, in Step ST20, the setting unit 63 may set the first current topographical data 71 and the second current topographical data 72 by any method, but in the present embodiment, for example, a measuring method for the current topographical data 70 set as the first current topographical data 71 and a measuring method for the current topographical data 70 set as the second current topographical data 72 are preliminarily determined, and the setting unit 63 sets the first current topographical data 71 and the second current topographical data 72 based on the methods by which the current topographical data 70 is measured.

Next, the arithmetic unit 64 calculates, for each grid area G, a difference of height data of the first current topographical data 71 from the second current topographical data 72 at the same position in the grid area G (Step ST30). Subsequently, the arithmetic unit 64 sets parameter information for each grid area G (Step ST40). In Step ST40, the arithmetic unit 64 can set various kinds of information as the parameter information. In the present embodiment, for example, the arithmetic unit 64 calculates, for each grid area G, an inclination angle relative to a horizontal plane, categorizes each grid area G as one of a plurality of groups based on an angle size of the calculated inclination angle, and sets the group as the parameter information. In Step ST40, the arithmetic unit 64 sets the parameter information by setting, for example, the angle groups from a first group to a seventh group based on the angle sizes of the inclination angles.

Next, the arithmetic unit 64 derives an estimated error function F1 based on the calculated differences and the parameter information (Step ST50). In Step ST50, the arithmetic unit 64 finds, for example, estimated error amounts (E1 to E7) for the respective angle groups, and derives the estimated error function F1 by correlating the angle groups to the estimated error amounts.

After that, for example, in the case of automatically controlling the work unit 20 based on the first current topographical data 71 in a grid area G not including the second current topographical data 72 and only including the first current topographical data 71, the correction unit 65 corrects the first current topographical data 71 based on the derived estimated error function F1 (Step ST60). After that, the navigation controller 40 and the work unit controller 50 may also control the work unit 20 based on the corrected first current topographical data 71 as the current topographical data 70. In this case, since the work unit 20 is controlled based on the first current topographical data 71 having more improved accuracy, the work unit 20 can be controlled accurately. Furthermore, since the work unit 20 can surely excavate the ground of a work site, so-called missed swing of the blade 21 can be avoided.

Meanwhile, after Step ST50 or Step ST60, the bulldozer 100 newly travels in a grid area G not including so far highly-accurate second current topographical data 72 and including only relatively low-accurate first current topographical data 71 and then new second current topographical data 72 is generated for this grid area G, the adjustment unit 66 may perform processing to update the estimated error function F1. In this case, the adjustment unit 66 updates the estimated error amount based on the difference data 82 of the first current topographical data 71 from the second current topographical data 72.

As described above, the work machine control system 200 according to the present embodiment includes: the acquisition unit 62 adapted to acquire the plurality of pieces of current topographical data 70 for the work site where the bulldozer 100 performs work; the setting unit 63 adapted to set the first current topographical data 71 and the second current topographical data 72 from the plurality of pieces of current topographical data 70 acquired by the acquisition unit 62; and the arithmetic unit 64 adapted to calculate a difference between the first current topographical data 71 and the second current topographical data 72, and find an estimated error function F1 that is revision data to revise the first current topographical data 71 based on the difference and the parameter information related to the current topography of the work site.

Furthermore, the work machine control system 200 according to the present embodiment finds, for each grid area G, an inclination angle relative to a horizontal plane as parameter information and categorizes the found inclination angle as one of a plurality of angle groups based on the angle size. Therefore, even when the number of grid areas G for which inclination angles are found is increased, the number of parameter information is not increased and kept constant. Therefore, a large amount of information can be efficiently processed.

According to this configuration, the first current topographical data 71 and the second current topographical data 72 are set from among the acquired plurality of pieces of current topographical data 70, the estimated error function F1 of the first current topographical data 71 is calculated by using the second current topographical data 72 as the teaching data, and the first current topographical data 71 can be revised based on the estimated error function F1. Therefore, accuracy of the first current topographical data 71 can be improved.

While the embodiment has been described above, note that the embodiment is not limited by the described content. Further, the components described above may include a component readily conceivable by those skilled in the art, a component substantially identical, and a component in a so-called equivalent range. Further, the components described above can be suitably combined. Furthermore, at least one of various kinds of omission, replacement, and modification can be made for the components in the scope without departing from the gist of the embodiment. For example, the respective processing executed by the navigation controller 40 may also be executed by the display controller 30, work unit controller 50, or a controller other than these.

Furthermore, in the above embodiment, the description has been provided by exemplifying the bulldozer 100 as a work machine, but not limited thereto, a different work machine such as an excavator or a wheel loader may also be used. Additionally, the control system 200 of the above embodiment may be provided in a work machine such as the bulldozer 100, may also be provided in the management server 300 and the like, or may also be shared by a work machine and a management server.

Moreover, in the above embodiment, the description has been provided by exemplifying the case where the measuring method for the current topographical data 70 set as the first current topographical data 71 and the measuring method for the current topographical data 70 set as the second current topographical data 72 are preliminarily determined, and the setting unit 63 sets the first current topographical data 71 and the second current topographical data 72 based on the methods by which the current topographical data 70 is measured, but not limited thereto. For example, the setting unit 63 may set the first current topographical data 71 and the second current topographical data 72 based on a command or input by an operator. In addition, the setting unit 63 may preliminarily set, for example, priority order or quantified accuracy information in accordance with each measuring method for current topographical data 70, and may set the first current topographical data 71 and the second current topographical data 72 based on the priority order or the accuracy information. Moreover, for example, the setting unit 63 may compare the plurality of pieces of current topographical data 70 acquired by the acquisition unit 62 with correct current topographical data preliminarily measured by a surveying instrument such as a laser scanner, and may set current topographical data 70 having a large difference as the first current topographical data 71 and set current topographical data 70 having a small difference as the second current topographical data 72.

Meanwhile, in the above embodiment, the setting unit 63 sets, as the first current topographical data 71, current topographical data 70 in the case of measuring a current topography by using positional information of a vehicle which travels in a work site, and sets, as the second current topographical data 72, current topographical data 70 in the case of measuring a current topography by using positional information of a work machine such as the bulldozer 100 which travels in the work site, but not limited thereto. For example, in the case of measuring the current topography by using positional information of a vehicle or the like, accuracy may be varied by accuracy and a calculation algorithm of each kind of a sensor. Therefore, the current topographical data 70 in the case of measuring a current topography by using the positional information of the vehicle may be set as the second current topographical data 72, and the current topographical data 70 in the case of measuring the current topography by using the positional information of the work machine may be set as the first current topographical data 71.

Figure 11:
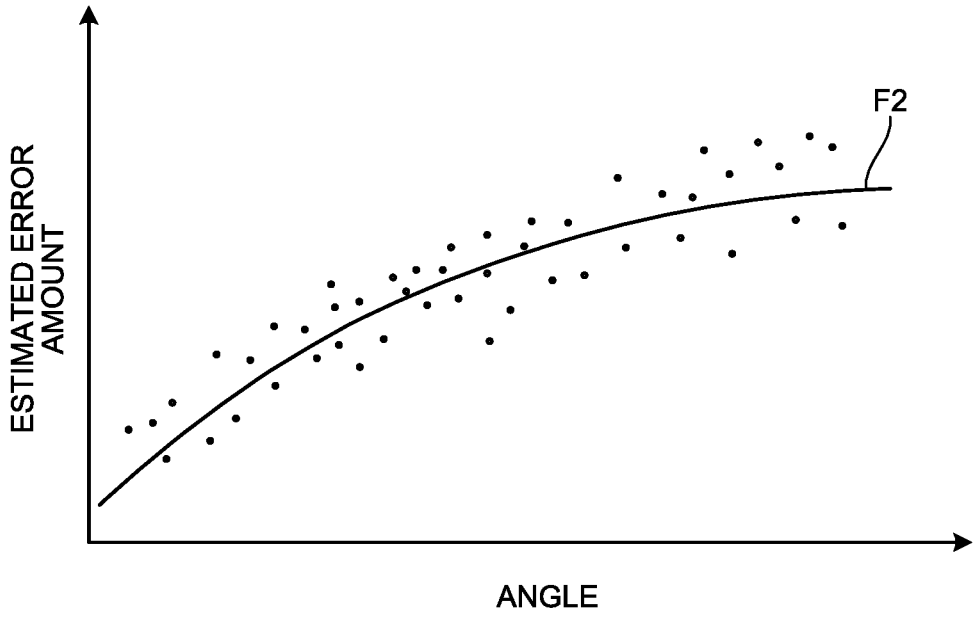
FIG. 11 is a graph illustrating an estimated error function according to a modified example.

Additionally, in the above embodiment, an inclination angle relative to a horizontal plane is found for a grid area G as parameter information, and the inclination angle is categorized as one of the plurality of angle groups based on the angle size, but not limited thereto. FIG. 11 is a graph illustrating an estimated error function according to a modified example.

For example, in the case of using the inclination angle relative to the horizontal plane for a grid area G as the parameter information, the arithmetic unit 64 may find, for each of the grid areas G, a relation between an inclination angle and an estimated error amount, derive an approximate curve based on respective values, and set the approximate curve as an estimated error function F2 as illustrated in FIG. 11. The approximate curve can be found by an approximation method such as a least-square method. Furthermore, the approximate curve can be a curve determined by a quadratic function, or a cubic or higher function. In this case, the correction unit 65 corrects the first current topographical data 71 based on the estimated error function F2. The estimated error function F2 is an example of revision data.

Furthermore, the revision data is not limited to the above-described estimated error function F1 and estimated error function F2, and any type of data may be applied.

Furthermore, in the above-described embodiment, the description has been provided for the case of using, as the parameter information, the inclination angle relative to the horizontal plane related to the grid area G, but not limited thereto. For example, as the time of receiving GNSS radio waves, the antenna 12 also receives accuracy information in addition to positional information. In this case, the navigation controller 40 stores, in the storage unit 45, the received accuracy information in a manner correlated to the positional information as the data for each grid area G. For example, in the case where the current topographical data 70 is generated in the current topographical data calculation unit 61 and the like based on positional information included in the GNSS radio waves, the arithmetic unit 64 may use the accuracy information included in the GNSS radio waves as the parameter information of the first current topographical data 71.

Furthermore, for example, water content of earth and sand to be working targets in a work site, and geological information such as compositions of soil or rocks may also be used as the parameter information. In this case, the navigation controller 40 stores, in the storage unit 45, for example, the geological information measured by a measuring instrument and the like as the data for each grid area G in a manner correlated to the positional information. Consequently, the arithmetic unit 64 can use, for example, the geological information measured by a measuring device and the like as the parameter information.

Furthermore, for example, a time when the current topographical data 70 is generated or a time when the acquisition unit 62 acquires the current topographical data 70 may be written in the current topographical data 70 as time information, and such time information may also be used as the parameter information. In this case, it can be estimated, for example, that the older time current topographical data 70 is acquired, the larger an error is.

Additionally, for example, the navigation controller 40 may store, in the storage unit 45, measuring method data indicating measuring methods at the time of generating current topographical data 70 in a manner correlated to the current topographical data 70 or as data for each grid area G. In this case, the setting unit 63 sets the first current topographical data 71 and the second current topographical data 72 based on the measuring methods for the current topographical data 70. Furthermore, the arithmetic unit 64 may preliminarily set a revision amount of the first current topographical data 71 based on a difference of the measuring method between the first current topographical data 71 and the second current topographical data 72, and may uniformly revise the first current topographical data 71 based on the revision amount.

REFERENCE SIGNS LIST

α Angle
E1, E2, E3, E4, E5, E6, E7 Estimated error amount
F1, F2 Estimated error function
G, Ge, Gn, Gs, Gt, Gw Grid area
10 Vehicle body
11 Travel device
11*a* Crawler
20 Work unit
21 Blade
21*p* Blade edge
30 Display controller
31 Input unit
32 Communication unit
33 Output unit
34 Processing unit
35 Storage unit
40 Navigation controller
50 Work unit controller
61 Current topographical data calculation unit
62 Acquisition unit
63 Setting unit
64 Arithmetic unit
65 Correction unit
66 Adjustment unit
67 Display control unit
70 Current topographical data
71 First current topographical data
72 Second current topographical data
80 Design topographical data
81 Virtual design data
82 Difference data
100 Bulldozer
200 Control system
300 Management server

The invention claimed is:

1. A work machine control system comprising:

an acquisition unit configured to acquire first current topographical data and second current topographical data of a work site where a work machine including a work unit performs work, the second current topographical data being obtained by a different measuring method from a measuring method by which the first current topographical data is obtained, the first current topographical data having a lower measurement accuracy than the second current topographical data;

an arithmetic unit configured to calculate a difference between the first current topographical data having the lower measurement accuracy and the second current topographical data, and obtain revision data to correct height data of the first current topographical data based on the difference and parameter information related to a current topography of the work site;

a correction unit configured to correct the height data of the first current topographical data based on the revision data; and a work unit control unit configured to control the work unit based on the first current topographical data corrected by the correction unit, wherein the second current topographical data is measured by using positional information of the work machine which travels in the work site, and the first current topographical data is measured by using positional information of a vehicle of which a travel speed during the measurement is faster than a travel speed of the work machine.

2. The work machine control system according to claim 1, further comprising an adjustment unit configured to adjust an estimated error function based on the second current topographical data newly acquired.

3. The work machine control system according to claim 1, further comprising a setting unit configured to set the first current topographical data and the second current topographical data based on a measuring method of the current topographical data acquired by the acquisition unit.

4. The work machine control system according to claim 1, wherein the parameter information includes at least one of inclination angle information in the current topographical data, geological information of the work site, accuracy information, and time information related to a time of acquiring the current topographical data.

5. A work machine comprising:

a travel unit mounted with a work unit and configured to travel; and the work machine control system according to claim 1.

6. A work machine control method comprising:

acquiring first current topographical data and second current topographical data of a work site where a work machine including a work unit performs work, the second current topographical data being obtained by a different measuring method from a measuring method by which the first current topographical data is obtained, the first current topographical data having a lower measurement accuracy than the second current topographical data;

calculating, via one or more processors, a difference between the first current topographical data having the lower measurement accuracy and the second current topographical data, and obtaining revision data to correct height data of the first current topographical data based on the difference and parameter information related to a current topography of the work site;

correcting, via one or more processors, the height data of the first current topographical data based on the revision data; and controlling, via one or more processors, the work unit based on the corrected first current topographical data, wherein the second current topographical data is measured by using positional information of the work machine which travels in the work site, and the first current topographical data is measured by using positional information of a vehicle of which a travel speed during the measurement is faster than a travel speed of the work machine.

* * * * *